United States Patent [19]

Dunn et al.

[11] 3,955,587

[45] May 11, 1976

[54] CHANGEABLE-SHAPE HAIR PIECE AND METHOD OF STYLING AN ARTIFICIAL COIFFURE

[75] Inventors: Ralph Dunn, Los Angeles; J. Stephen Lewis, Pacific Palisades; Mellie M. Phillips, Los Angeles, all of Calif.

[73] Assignee: Mattel, Inc., Hawthorne, Calif.

[22] Filed: Sept. 28, 1972

[21] Appl. No.: 293,233

[52] U.S. Cl. ..... 132/53

[51] Int. Cl.[2] ..... A41G 3/00

[58] Field of Search ..... 132/53, 40, 42, 39, 132/33, 7

[56] References Cited

UNITED STATES PATENTS

| | | | |
|---|---|---|---|
| 2,066,709 | 1/1937 | Adams | 132/43 A |
| 2,140,583 | 12/1938 | Jacobs | 132/43 A |
| 2,889,834 | 6/1959 | Anderson et al. | 132/7 |
| 3,077,891 | 2/1963 | Lane | 132/5 |
| 3,614,843 | 10/1971 | Hawtin et al. | 132/53 |

*Primary Examiner*—G. E. McNeill

*Attorney, Agent, or Firm*—Stephen L. King; Max E. Shirk; John G. Mesaros

[57] ABSTRACT

Ductile filaments, such as 37–43 gauge plastic coated metal wire, are distributed throughout hair filaments in such a manner that a small number of ductile filaments may be used to hold a large number of hair filaments in a changeable-shape coiffure. The ductile filaments may be distributed throughout any body of living hair or hair which is attached to a base member.

21 Claims, 6 Drawing Figures

FIG. 1
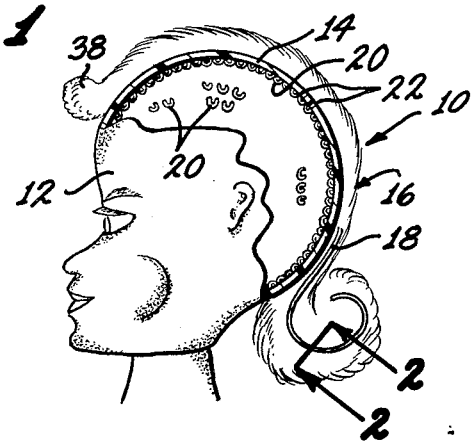
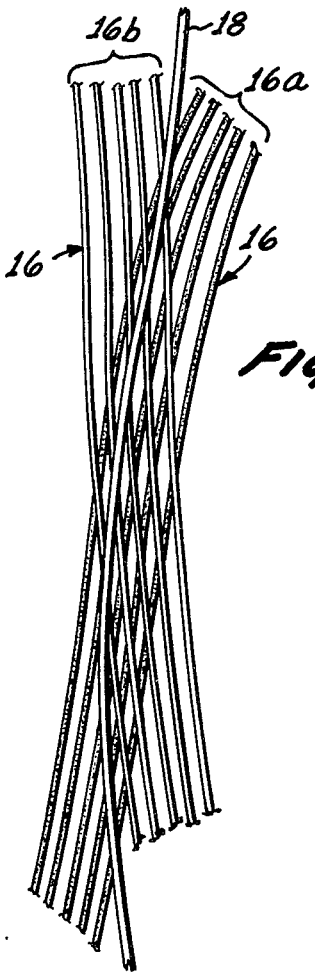
FIG. 2
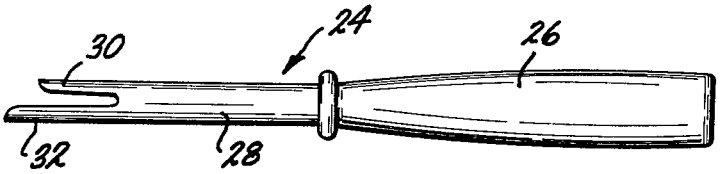
FIG. 4
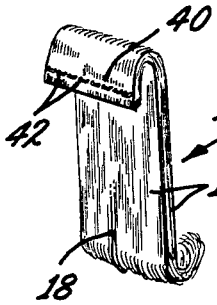
FIG. 6
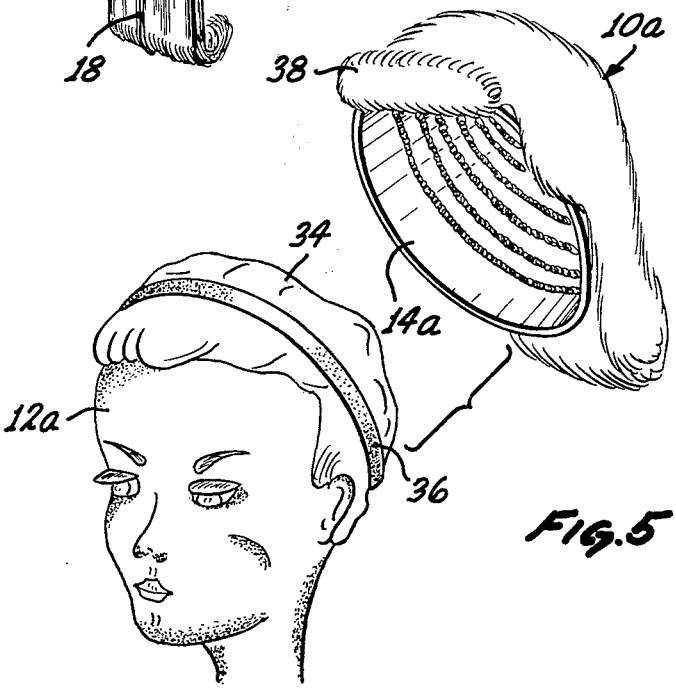
FIG. 5
FIG. 3
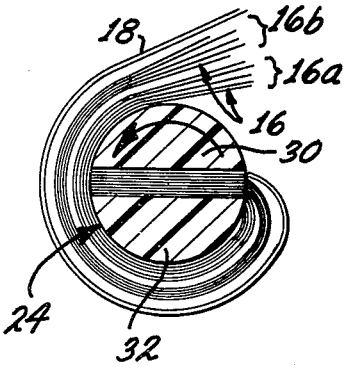

CHANGEABLE-SHAPE HAIR PIECE AND METHOD OF STYLING AN ARTIFICIAL COIFFURE

BACKGROUND OF THE INVENTION

The background of the invention will be set forth in two parts.

FIELD OF THE INVENTION

The present invention pertains generally to the field of hair styling and more particularly to a changeable-shape, body of hair which may be arranged and held in different styles by using a small number of ductile filaments to hold a large number of hair filaments in a suitable hair arrangement.

DESCRIPTION OF THE PRIOR ART

It is difficult to arrange both natural and artificial hair in a suitable arrangement without either wetting or heating the hair. This can result in messy conditions, especially when a child chooses to style the hair of her doll. It is also difficult to style certain bodies of hair, such as mustaches, beards and the like, without using heavy waxes, sprays and the like. This, too, can result in messy conditions.

The prior art known to applicants is listed by way of illustration, but not of limitation, in separate communications to the United States Patent Office. Included in this prior art is U.S. Pat. No. 2,393,858 which discloses a separate edge forming element for wigs wherein a metallic strip, having a series of fine wires projecting laterally therefrom, is applied to the edge of the wig so that the edge will lie close to the skin with the wires being cut to represent the hair line.

The changeable-shape coiffure of the present invention is to be distinguished over coiffures or wigs of the type disclosed in U.S. Pat. No. 2,393,858 because the wire used in the present invention is not intended to represent a hair line, but is used to hold the hair in a predetermined, dry set.

OBJECTS AND SUMMARY OF THE INVENTION

In view of the foregoing, it is a primary object of the present invention to provide a new and useful changeable shape coiffure not subject to the disadvantges of the prior art and including means for holding hair filaments in a predetermined, dry set.

Another object of the present invention is to provide a new and useful method of styling hair filaments in a predetermined, curled dry set.

According to the present invention, hair filaments are maintained in a predetermined, curled dry set by dispersing throughout the hair filaments a plurality of ductile filaments and by coiling groups of the ductile filaments and the hair filaments about a mandrel in a coil which exceeds the elastic limit of each of the ductile filaments, whereby each of the ductile filaments is permanently deformed and exerts sufficient torque on at least a major portion of the hair filaments in a group to hold them in a curled, dry set.

In a first embodiment of the present invention, a hair piece is affixed to a suitable base member, such as a doll's head, by using conventional hair-rooting machinery to affix hair filaments and ductile filaments to the head.

The hair filaments may comprise any suitable natural or synthetic hair filament with precurled polymeric filaments being preferred. The ductile filaments may comprise plastic-coated metal wire of from 37–43 AWG. Although different gauges and larger quantities of wire could be used for holding the hair filaments in a predetermined, dry set, the sizes and quantities herein specified are preferred because the finished hair piece does not have a satisfactory look and feel when the wire is too heavy and is used in too great a quantity. Although lighter wire could be used, it is more convenient to use the gauges herein specified because lighter wire tangles and breaks too easily.

In a second embodiment of the present invention, a replaceable base member is employed so that the hair piece may be used on a number of different objects, such as doll heads, human heads and the like.

In a third embodiment, the base member is dispensed with and ductile filaments are intermingled with hair filaments in a bundle with the ends of the filaments being knotted, sewn, or otherwise bound together so that the resulting hair piece may be used as a fall, pigtails, ponytail or the like.

The features of the present invention which are believed to be novel are set forth with particularity in the appended claims. The present invention, both as to its organization and manner of use, together with further objects and advantages thereof, may best be understood by reference to the following description, taken in connection with the accompanying drawings in which like reference characters refer to like elements in the several views.

BRIEF DESCRIPTION OF THE DRAWINGS

FIG. 1 is a side elevational view, with parts broken away to show internal construction, of a doll head having a hair piece constituting a first embodiment of the present invention;

FIG. 2 is an enlarged cross-sectional view taken along line 2—2 of FIG. 1;

FIG. 3 is an enlarged, cross-sectional view of a swatch of hair from the hair piece of FIG. 1 wound about a mandrel;

FIG. 4 is an elevational view of a mandrel suitable for use in curling the hair in the manner shown in FIG. 3;

FIG. 5 is an exploded, perspective view of a hair piece constituting a second embodiment of the present invention; and FIG. 6 is an elevational view of a hair piece constituting a third embodiment of the present invention.

DESCRIPTION OF THE PREFERRED EMBODIMENTS

Referring again to the drawings and more particularly to FIGS. 1–4, a hair piece constituting a first embodiment of the present invention, generally designated 10, is shown for purposes of illustration, but not of limitation, as forming an integral part of a doll head 12 having a scalp 14 molded from a suitable soft, plastic material, such as a soft polyvinyl chloride.

Scalp 14 comprises a base member for a plurality of hair filaments 16 and ductile filaments 18 (FIGS. 2 and 3) which may be affixed thereto by interlocking loops or stitches 20. A needle or needles (not shown) on conventional hair-rooting machinery may be used to pull filaments 16, 18 through skull or base member 14 in known manner. Loops 20 are also formed in known manner and lock the hair filaments 16 and the ductile filaments 18 together adjacent apertures 22, which are formed in skull 14 by the hair-rooting machinery. Filaments 16, 18 may be uniformly distributed over base member 14 by applying loops or stitches 20 in a suitable convoluted pattern, as will be more fully described hereinafter in connection with FIG. 5.

The filaments 16, 18 in each stitch 20 will tend to arrange themselves in groups, as shown in FIG. 2, wherein 10 filaments 16 and one filament 18 are shown for purposes of illustration, but not of limitation. The filaments 16 will tend to arrange themselves in a first group **16*a* and a second group 16*b* which overlies group 16*a*. Filaments 18 will then overlie group 16*b* with the result that filament 18 tends to hold filaments 16 in a predetermined, dry set. For example, when filaments 16, 18 are wound upon a mandrel 24 (FIGS. 3 and 4) filament 18 continues to overlie group 16*b* which, in turn, overlies group 16*a* as the filaments 16, 18 are wound upon mandrel 24. This winding deforms filament 18 in such a manner that its elastic limit is exceeded causing it to retain the curl imparted thereto by mandrel 24. Thus, when mandrel 24 is removed, filaments 16, 18 will be maintained in a curled, dry set by filament 18**.

As best seen in FIG. 4, mandrel 24 includes a handle portion 26 and a bifurcated end 28 having tangs 30, 32. Tang 30 is shorter than tang 32 to facilitate inserting a swatch of hair, such as the filaments 16, 18 shown in FIG. 2, therebetween.

Referring now to FIG. 5, a hair piece constituting a second embodiment of the present invention, generally designated **10*a*, may be identical to the hair piece 10, except that the base member 14 is replaced by a base member 14*a* comprising a skull cap adapted to fit the head 12*a* having its own hair 34 which may be drawn up on top of head 12*a* and held in place by a ribbon or band 36 so that hair 34 is completely covered by skull cap 14*a*. It will be apparent to those skilled in the art that skull cap 14*a*** may be made from heavy gauze, loose netting having strips of bound filaments attached thereto or an arrangement of suitable strips of material having the filaments affixed thereto.

Referring now to FIG. 6, a hair piece constituting a third embodiment of the present invention, generally designated **10*b*, dispenses with a base member by binding the first end 40 of filaments 16, 18 together with suitable means, such as stitches 42. Hairpiece 10*b*** may then be affixed to a body of hair (not shown) by hair pins, or the like, and worn as a fall, pigtails, a ponytail or similar item.

In all three embodiments of the present invention, mandrel 24 may be used to arrange the hair pieces **10, 10*a* and 10*b* in a suitable coiffure having a changeable shape. Additionally, hair pieces 10 and 10*a* may include bangs 38 which may be held in a curl by the action of a plurality of ductile filaments 18**.

Certain phrases and words used herein shall be defined as follows:

ductile filament = a flexible thread capable of being permanently deformed without a brittle fracture.
gauge = American Wire Gauge.
wire = a ductile filament.
hair = a slender thread-like outgrowth of the epidermis of an animal or any natural or synthetic filament simulating such an outgrowth.
PVDC = polyvinylidene chloride.

A number of different types of material may be used for the hair filaments 16, including natural hair and synthetic hair. Although many polymers may be used, commercially-available doll-hair yarn of a polyvinylidene chloride having 60 denier per strand and 10 strands per yarn with ½ inch diameter, heat-set, per-curl is preferred from the standpoint of economy and results obtained. The individual filaments may be either hollow or solid and straight filaments which have not been previously heat-set into a ½ inch diameter curl may also be used. Other polymers which work satisfactorily are polypropylene and nylon. Additionally, the polymers may have a filament denier from 25 to 120.

Although 41 gauge, annealed plastic-coated, copper wire is preferred for filaments 18, other gauges and types of ductile wire are satisfactory. The preferred gauge range for the wire is 37–43. Heavier wire does not provide sufficient additional holding power to warrant using it at its increased cost and thinner wire tends to break during the hair-rooting operation. Brass wire works well if adequately annealed, but is not easily available commercially. Silver and gold wire would, of course, work very well, but are not economically feasible. If more than about 7 wire filaments of 41 gauge are used per 10 filaments of 60 denier polymeric material, the finished hair pieces lose some of their natural feel and appearance. If less than about one 41 gauge wire per 180 filaments of 32 denier polymeric material is used, the holding power of the wire is spread over too many hair filaments to retain the hair in a dry-set curl against the weight and stiffness of the hair.

A number of hair pieces were made using 41 AWG (0.0028 dia.) annealed plastic coated (0.0031 dia. overall) copper wire in the ratios and with the polymers shown in the following table:

| POLYMER | PRE-CURL DIA. (IN.) | FILAMENT DENIER | WIRES/ FILAMENTS (COUNT) | RESULTS |
|---|---|---|---|---|
| PVDC | ½ | 60 | 7/10 | Acceptable |
| PVDC | ½ | 120 | 7/9 | Acceptable-softer than 7/10 at 60d |
| Hollow PVDC | ½ | 109 | 7/9 | Ditto |
| Polypropylene | none | 28 | 7/24 | Very good-soft feel |
| Polypropylene | ½ | 32 | 7/15 | Ditto |
| Nylon | ½ | 25 | 7/24 | Acceptable |
| Nylon | ½ | 50 | 7/12 | Ditto |
| PVC | none | 25 | 7/24 | Acceptable, but a few stray ends left the curl. |
| PVDC | ½ | 120 | 1/108 | Not acceptable-curl did not hold. |
| Hollow PVDC | ½ | 109 | 1/108 | Ditto |
| PVDC | ½ | 60 | 1/120 | Acceptable |
| Propypropylene | none | 28 | 1/144 | Acceptable, but a few stray ends left |

-continued

| POLYMER | PRE-CURL DIA. (IN.) | FILAMENT DENIER | WIRES/FILAMENTS (COUNT) | RESULTS |
|---|---|---|---|---|
| | | | | the curl. |
| Polypropylene | ½ | 32 | 1/180 | Very good. |
| Nylon | ½ | 50 | 1/144 | Not acceptable-curl did not hold. |
| Nylon | ½ | 25 | 1/288 | Ditto |

The results shown in the above table are based on the appearance and feel of the hair piece and the holding power of the ductile filaments.

The plastic coating on the wire prevents tarnishing and oxidation of the metal and preserves the bright finish. It also reduces kinking, improves lubricity and increases the safety of the wire. The color of the plastic coating need not exactly match the color of the hair filaments because natural hair filaments do not match each other exactly. Thus the finished coiffure will look more natural if there is a slight amount of mismatching between the colors of the ductile filaments and the hair filaments. The optimum range of wire-to-hair using 41 gauge copper wire and 600/10d PVDC yarn is from one ductile filament and 5 hair filaments to one ductile filament and 30 hair filaments.

Concerning the highest range of 60d PVDC which still gave satisfactory results, it was found that 41 gauge copper wire could be used with 600/10d PVDC hair filaments in a ratio as low as 1 ductile filament to 120 hair filaments to produce adequate holding power for a dry-set curl over a period of time and that the curl resisted shaking out. Hair pieces made with the same PVDC hair filaments and no ductile filaments did not exhibit these properties. With 32d polypropylene hair filaments and 41 AWG copper wire, a ratio as low as 1 ductile filament to 180 hair filaments produced satisfactory results.

THE METHOD OF THE PRESENT INVENTION

According to the method of the present invention, a new, non-analogous use for metal wire was found in the styling of hair filaments in a predetermined curled dry set comprising the steps of dispersing throughout the hair filaments a plurality of ductile filaments and coiling groups of the ductile filaments and the hair filaments about a mandrel in a coil which exceeds the elastic limit of each of the ductile filaments so that each ductile filament is permanently deformed and exerts sufficient torque on at least a major portion of the hair filaments in a particular group to hold them in a curled, dry set. The ductile filaments are preferably of substantially the same diameter, color and length as the hair filaments. Additionally, the hair filaments are preferably made from a pre-curled polymer and the ductile filaments are preferably made from plastic-coated metal wire lying within the range of 37–43 gauge.

EXAMPLE 1

A small plastisol doll head was rooted in conventional manner using a single-needle machine of the type which makes interlocking loops of the hair rooting material on the underside of the doll's skull. Conventional 600/10 denier (60 d per strand) doll hair yarn made from PVDC with a ½ inch diameter, heat-set pre-curl was used for the hair filaments.

A ductile filament comprising 41 AWG (0.0028 dia.) annealed plastic coated copper wire having an overall diameter of 0.0031 inches was disbursed throughout the hair filaments by including a single wire filament in the hair yarn which was fed to the rooting needle.

The hair and ductile filaments were cut to a uniform length and groups of swatches of the hair, including at least one ductile filament and a plurality of hair filaments, were wound about a mandrel to form a curl. The filaments were wound in a sufficiently tight curl that the elastic limit of each ductile filament was exceeded so that the ductile filaments became permanently deformed, thereby exerting sufficient torque on the hair filaments to hold them in a curled, dry set.

The ductile filaments were of substantially the same length, diameter and color as the hair filaments.

EXAMPLE 2

The steps of Example 1 were followed, except that 42 AWG copper wire and un-curled polypropylene hair yarn having 680/24 denier were used in the ratio of 7 ductile filaments to 24 hair filaments.

EXAMPLE 2A

The steps of Example 1 were followed, except that the hair filaments were 32d and the wire filaments were dispersed throughout the hair filaments at the rate of 1 ductile filament to 180 hair filaments.

EXAMPLE 3

A hair piece was made following the steps of Example 1 except that 40 AWG annealed, plastic coated copper wire was used for the ductile filament.

EXAMPLE 4

A hair piece was made in accordance with the method of Example 1 except that 39 AWG annealed, plastic coated copper wire was used for the plastic filament.

EXAMPLE 5

A hair piece was made in accordance with the method of Example 1 except that 38 AWG annealed, plastic coated copper wire was used for the ductile filament.

EXAMPLE 6

A hair piece was made in accordance with the method of Example 1 except that 37 AWG annealed, plastic coated copper wire was used for the ductile filament.

EXAMPLE 7

A hair piece was made in accordance with Example 1 except that 41 AWG annealed brass wire was used for the ductile filament.

EXAMPLE 8

A hair piece was made in accordance with Example 1 except that the copper wire was silver plated with a plastic coating over the silver plating.

EXAMPLE 9

A hair piece was made in accordance with the method of Example 1 except that the hair yarn was 1080/9 denier and 7 ductile filaments were used to 9 hair filaments.

EXAMPLE 10

A hair piece was made in accordance with the method of Example 1 except that a polypropylene hair yarn of 480/15 denier and having a ½ inch diameter pre-curl was used in the ratio of 7 ductile filaments to 15 hair filaments.

EXAMPLE 11

A hair piece was made in accordance with the method of Example 1 except that the hair filaments were made from nylon having a ½ inch diameter pre-curl and a yarn denier of 600/12 with the ductile filaments being disbursed throughout the hair filaments at the rate of 7 ductile filaments to 12 hair filaments.

EXAMPLE 12

A hair piece was made in accordance with the method of Example 1 except that the ductile filaments were disbursed throughout the hair filaments at the rate of 1 ductile filament to 120 hair filaments.

The hair pieces produced in accordance with Examples 1–12 all had an acceptable appearance, tactual quality and dry setting ability.

EXAMPLE 13

A hair piece was made in accordance with Example 1 except that the yarn denier of the hair filaments was 1080/9 (120 d per filament) and the ductile filaments were disbursed throughout the hair filaments at the rate of 1 ductile filament to 108 hair filaments.

This hair piece could not be satisfactorily dry set because the weight of the polymer was too great for the holding power of the ductile filament and the curls could be easily shaken out.

EXAMPLE 15

A hair piece was made in accordance with the method of Example 1 except that the ductile filaments were dispersed throughout the hair filaments at the rate of 1 ductile filament to 1 hair filament.

The resulting hair piece did not have a natural appearance and tactual quality. However, dry set curls could not be shaken out.

While the particular embodiments of the invention herein shown and described in detail are fully capable of attaining the objects and providing the advantages hereinbefore stated, it is to be understood that they are merely illustrative of the presently preferred embodiments of the invention and that no limitations are intended to the details of construction or design herein shown other than as defined in the appended claims, which form a part of this disclosure. Whenever the term "means" is employed in the appended claims, this term is to be interpreted as defining the corresponding structure illustrated and described in this specification or the equivalent of the same.

What is claimed is:

1. A method of styling and maintaining freely flexible hair filaments in a predetermined curled dry arrangement, comprising the steps of:

dispersing throughout said hair filaments, in intermingled relation therewith, a plurality of separate ductile filaments;

coiling groups of said ductile filaments and said hair filaments into a coil which exceeds the elastic limit of each of said ductile filaments whereby each of said ductile filaments is deformed and exerts sufficient torque on at least a major portion of the hair filaments in a group to hold them in a curled dry arrangement; and maintaining said coiled ductile filaments in said groups of hair filaments to hold them in said arrangement.

2. The method of claim 1 wherein each of said ductile filaments is of substantially the same diameter as said hair filaments.

3. The method of claim 1 wherein each of said ductile filaments is of substantially the same color as said hair filaments.

4. The method of claim 1 wherein each of said ductile filaments has substantially the same diameter, color and length as said hair filaments.

5. The method of claim 1 wherein said hair filaments are made from a pre-curled polymer.

6. The method of claim 1 wherein said ductile filaments are made from plastic-coated metal wire.

7. The method of claim 6 wherein said plastic-coated metal wire lies within the range of 37–43 AWG.

8. An artificial coiffure, comprising:

a plurality of freely flexible hair filaments; and a plurality of separate ductile filaments uniformly distributed throughout said plurality of hair filaments, said ductile filaments forming an integral part of said coiffure and being deformed beyond their elastic limits into a predetermined hair style and exerting a force on said hair filaments to hold them in said predetermined style.

9. An artificial coiffure as stated in claim 8 wherein said ductile filaments are distributed in a ratio lying within the range of from about 7 ductile filaments to 10 hair filaments to about 1 ductile filament to 180 hair filaments.

10. An artificial coiffure as stated in claim 8 wherein said ductile filaments have a predetermined diameter and color substantially the same as the diameter and color of said hair filaments.

11. An artificial coiffure as stated in claim 8 wherein said hair filaments are made from a pre-curled polymer.

12. An artificial coiffure as stated in claim 8 wherein said ductile filaments are made from plastic-coated metal wire.

13. An artificial coiffure as stated in claim 12 wherein said plastic-coated metal wire lies within the range of 37–43 AWG.

14. In a changeable-shape hair piece having a plurality of freely flexible hair filaments, the improvement which comprises:

a plurality of separate ductile filaments substantially uniformly distributed throughout said hair filaments over at least a major portion of said hair piece as a permanent part thereof and being sufficiently rigid to hold the bulk of the hair filaments in a selected coiffure, wherein said hair piece is held in form and shape by the action of said ductile filaments holding the bulk of said hair filaments in a selected shape.

15. A hair piece as stated in claim 14 including a base member, said hair filaments and said ductile filaments being attached to said base member by suitable stitches.

16. A hair piece comprising:

a base member;

a plurality of freely flexible hair filaments affixed to said base member; and a plurality of ductile filaments affixed to said base member, said hair filaments exceeding said ductile filaments in a quantity at least as great as 10 hair filaments to 7 ductile filaments, said ductile filaments being uniformly distributed throughout said hair filaments over a major portion of said base member.

17. A hair piece as stated in claim 16 wherein said hair filaments are made from a polymeric material.

18. A hair piece as stated in claim 16 wherein said ductile filaments are plastic-coated metal wire of 37–43 AWG.

19. A hair piece as stated in claim 16 wherein said base member is a dool's head and wherein said hair filaments and said ductile filaments are attached to said doll's head by suitable stitching.

20. A hair piece as stated in claim 16 wherein said base member is a skull cap adapted to fit the head of a user of said hair piece.

21. In a changeable-shape hair piece having a base member and a plurality of freely flexible hair filaments connected to said base member, the improvement which comprises:

a plurality of ductile filaments holding the bulk of the hair filaments in a predetermined coiffure, wherein said hair piece takes form and shape by the action of said ductile filaments holding the bulk of said hair filaments in said changeable-shape, said hair filaments and said ductile filaments being affixed to said base by interlocking loops wherein said ductile filaments and said hair filaments are locked together in a plurality of stitches.

* * * * *